US006039283A

United States Patent [19]

Munoz-Baca et al.

[11] Patent Number: 6,039,283

[45] Date of Patent: Mar. 21, 2000

[54] THIN STRIP COILING SYSTEM

[75] Inventors: Julio Manuel Munoz-Baca, Nuevo Leon, Mexico; Klaus Bäumer; Erhard Bald, both of Hilchenbach, Germany

[73] Assignees: Hylsa S.A. de C.V., San Nicolas de los Garza, Mexico; SMS Schloemann-Siemag Aktiengesellschaft, Dusseldorf, Germany

[21] Appl. No.: 09/082,123

[22] Filed: May 19, 1998

[51] Int. Cl.[7] ..... B65H 18/08; B65H 23/00; B21C 47/00

[52] U.S. Cl. ..... 242/534; 242/548; 242/531.1; 242/615.1; 242/615.4; 72/148

[58] Field of Search ..... 242/534, 548, 242/531.1, 615.1, 566, 615.4; 226/181; 72/146, 148

[56] References Cited

U.S. PATENT DOCUMENTS 3,608,805 9/1971 Ogata ..... 226/181 X
3,844,189 10/1974 Jardine ..... 242/615.1 X
4,384,468 5/1983 Ginzburg ..... 72/202
5,009,092 4/1991 Buchegger ..... 72/148
5,131,134 7/1992 Quambush et al. ..... 29/527.7

*Primary Examiner*—John Q. Nguyen
*Attorney, Agent, or Firm*—A. Thomas; S. Safford; Frommer Lawrence & Haug LLP

[57] ABSTRACT

A coiling system for thin steel strip which avoids problems of thin steel strip winding on its pinch rolls and assures that the strip is guided towards the predetermined coiling roll, thus decreasing operational delays and increasing productivity of a thin gage hot rolling steel strip mill. The system comprises a flap guide positionable in at least two positions, a first position contacting a pinch roll during the initial threading period of each strip to be coiled, and a second normal operating position without contact with said pinch roll when the strip is being wound in said predetermined coiler. The flap guide may also be used in multiple coiler rolls systems and may be adapted for automatic operation.

20 Claims, 5 Drawing Sheets

THIN STRIP COILING SYSTEM

FIELD OF THE INVENTION

The present invention relates to a method and apparatus for guiding thin steel strip to be coiled in a continuous rolling mill to prevent said steel strip from getting coiled on rolls other than the intended coiler mandrel. The invention is particularly adapted for applications where hot rolled steel strip is produced from continuous cast slabs or bars.

Typical applications for the invention begin to be needed, for example, in metallic strip rolling mills where the thickness of the strip is below 2 mm, and particularly for steel where the thickness is below 1.5 mm.

BACKGROUND OF THE INVENTION

Thin hot rolled steel strip is generally produced by reducing the thickness of cast slabs in successive rolling steps until the desired thickness is reached. At the end of the rolling mill there is normally a coiler which winds up the strip into a coil for its handling.

The coiler comprises several supporting rolls and at least a pair of pinch rolls which drive the strip at the desired velocity and tension before it is engaged by and wound up on a coiler mandrel.

The pinch rollers are usually located at a higher position with respect to the coiler roll and a set of guiding plates forces the strip towards the coiler mandrel. The prior art coilers include a pivoted movable flap guide which can switch its position so that it diverts the strip head end towards one of a plurality of coiler mandrels in those mills comprising several coiling mandrels for higher productivity of the rolling mill.

The flap guide of the prior art leaves a gap of a minimum of 1 to 2 mm between the guide end and the upper pinch roll, chosen according to the expected strip thickness. Any smaller gap has not been thought practical due to normal play and tolerance variables. When the thickness of the strip is more than about 2.0 mm to 1.5 mm, generally no problems are found in handling the strip, but when the thickness is less than about 1.5 mm then the strip may pass through said gap and get wound up around the pinch roll, causing delays and generating scrap. The thinner the strip, the more flexibility, and the higher the resulting velocity (typically above 10 m/s for a 1.5 mm thickness or less). The high speed of the strip causes its head end traveling through the cooling section of the mill sometimes to lift upwardly and when the curvature of head end is about the same of the pinch roll, it is very likely that the strip will become wound up in said pinch roll. Therefore, the invention is particularly useful in coiling systems where thin steel strip is produced.

Although several proposals addressed to maintaining the head end of the strip within the normal path were considered and tried, the solution to this problem was finally discovered by the applicants when the conventional flap guide was redesigned and operated so that it makes brief non-abrasive actual close contact with the upper pinch roll as the strip head end passes the roll, actually eliminating the gap (thought previously in the prior art to be a necessary requirement). In order to avoid undesired relatively rapid wear and marking on the pinch roll surface, which in turn would affect the quality of the strip, the tip of the flap guide in contact with the pinch roll is made of a material having a very low friction coefficient. One of the preferred materials for this application is a composite fiber reinforced material known as "Micarta" (trademark of Westinghouse Electric Corporation) which finds many applications as a hard non-abrasive machinable material, but some other material may be used as long as it does not cause any significant wear or mark on the pinch rolls.

The following patents were found in a search made in connection with the present invention: U.S. Pat. No. 2,920,838 to Priestley; U.S. Pat. No. 4,047,416 to Johnson; U.S. Pat. No. 4,761,983 to Ginzburg et al. and U.S. Pat. No. 5,479,807 to Moser; the contents of which are incorporated herein by reference.

Priestley discloses a strip coiling apparatus for coiling continuous strip of a relatively heavy gauge, and is addressed to prevent objectionable markings of the strip caused by the pressure set up when the coiler rolls strike the strip at the overlap or point of increased coil diameter, and is also directed to providing curved guides and fluid jets which impinge upon the leading edge thus to cause the strip as it enters the coiler to be bent toward and forced against a peripheral surface of a rotating reel. This patent does not teach or suggest the solution provided by the present invention to prevent the winding problems encountered with thin gauge strip.

Johnson discloses an apparatus for uncoiling and straightening strip material of considerable thickness and for directing the leading edge of the uncoiled material to a straightening and feeding mechanism. This patent however does not disclose the problem of thin strip winding solved by the present invention.

Ginzburg et al. describes a method and apparatus for winding material onto a coiler drum along a passline of a hot reversing mill. The apparatus comprises an apron 34 pivotally moved by a hydraulic cylinder but is not used for preventing the strip material from winding on pinch rollers.

Moser discloses a coiler furnace for a hot strip comprising a strip-receiving guide having an end adjacent to the coiler drum when in a strip receiving position. This guide however is not intended to prevent the strip from winding on pinch rolls or to contact said rolls.

None of the above mentioned patents teach or suggest the problems solved by the present invention nor teach the construction and operation of a guide as claimed in the present invention.

OBJECTS AND SUMMARY OF THE INVENTION

It is therefore an object of the present invention to provide an improved coiling system for use in the production of thin steel strip, for example coiling systems associated with hot strip mills in continuous casting plants.

It is another object of the invention to provide an improved apparatus for guiding a thin steel strip to the mandrel of a coiler without interfering with the normal operation and high velocity movement of pinch rollers in said coiler.

Other objects of the invention will be in part obvious and in part pointed out hereinafter.

Accordingly a coiling system incorporating the present invention has several features which enable said coiling system to provide reliability and to lower operation costs of steelmaking plants reducing off times and yield loss.

The objects of the present invention are generally achieved by providing applicants' coiling system for handling a thin strip (as already generally described above), and more particularly also comprising the following: (a) at least a pair of pinch rolls and at least one coiler mandrel; (b) a guide located along the path followed by said thin strip traveling from said pinch rolls to said coiler mandrel, said guide being movable between at least two positions: a first position, where one end of said guide contacts one of said pinch rolls so that the thin strip is prevented from winding up around said pinch roll and also is forced to follow a predetermined path towards said coiler mandrel; and a second position, where said guide does not contact said pinch roll whereby unnecessary wearing or marking of the pinch roll surface is avoided during the coiling operation after the strip has been engaged by the coiler mandrel and is being wound up around said coiler mandrel.

In a further embodiment of the invention, the coiling system comprises a plurality of coiler mandrels and the guide is movable to a third position where said guide allows the strip to follow an alternate path towards another coiler mandrel while a finished coil made in another mandrel is being handled, thus increasing the productivity of the whole coiling system.

The guide includes a tip made of a non-abrasive low friction material, such as Micarta, so that it does not damage the surface of the pinch roll. The guide is positioned automatically in its first position in contact with the pinch roll in response to a first signal produced in a first sensor located in the upstream rolling mill indicating that a new slab is being rolled and that the head end of the strip is approaching the pinch rolls, and is positioned in its second position away of the pinch roll in response to a second signal produced by a second sensor located in the downstream coiling mandrel indicating that the strip is being wound up around said mandrel.

BRIEF DESCRIPTION OF THE DRAWINGS

In this specification and in the accompanying drawings, some preferred embodiments of the invention are shown and described and various alternatives and modifications thereof have been suggested; but it is to be understood that these are not intended to be exhaustive and that many changes and modifications can be made within the scope of the invention. The suggestions herein are selected and included for purposes of illustration in order that others skilled in the art will more fully understand the invention and the principles thereof and will thus be enabled to modify it in a variety of forms, each as may be best suited to the conditions of a particular use.

DETAILED DESCRIPTION OF THE INVENTION

Figure 1:
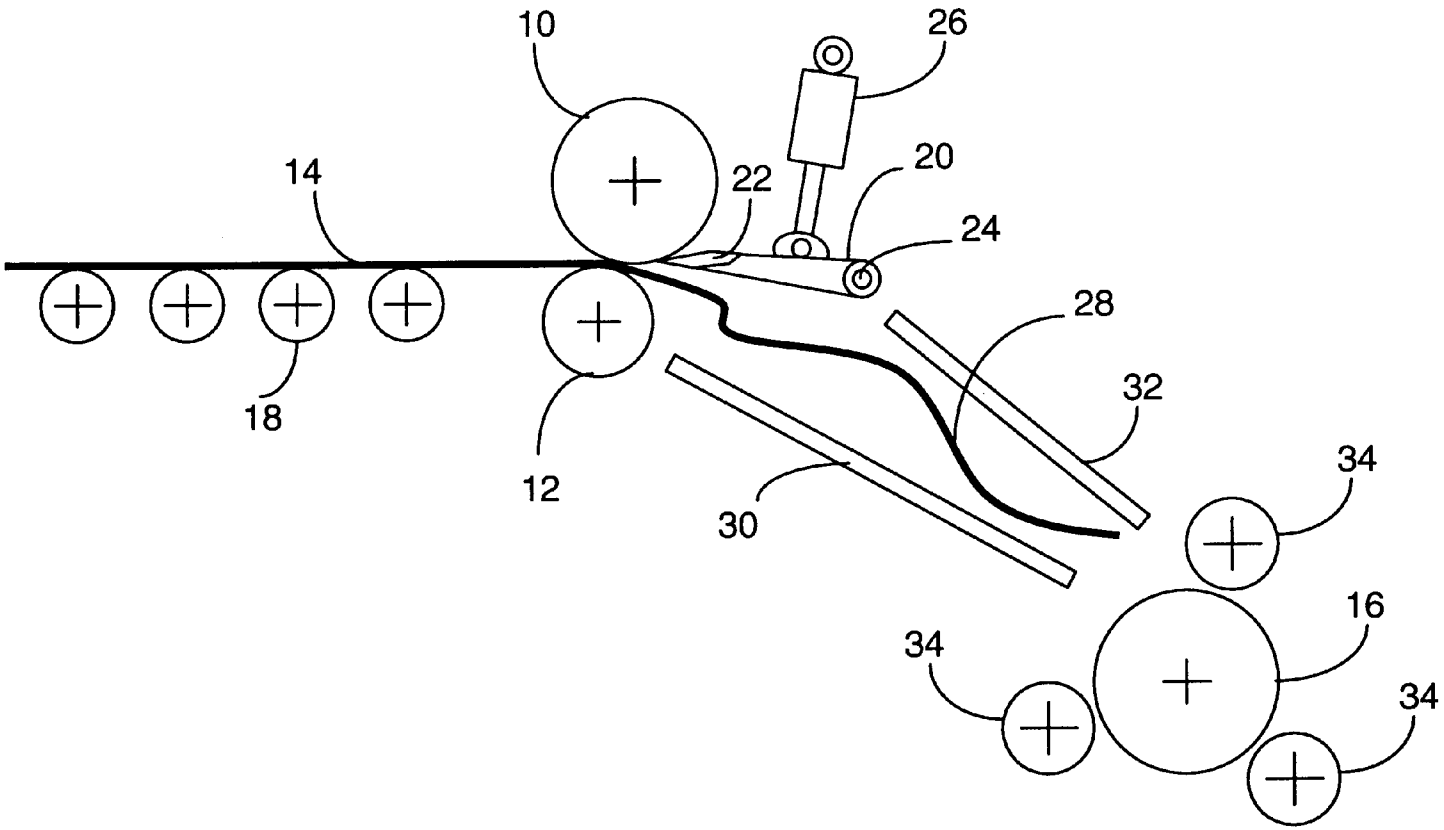
FIG. 1 is a schematic side elevational view of a preferred embodiment of the coiler system illustrating the flap guide in the first position contacting the pinch roll to prevent undesired adherence and winding up of the thin steel strip around the pinch roll during initiation of winding.

Although the invention will be described as applied to the production and coiling of hot rolled steel strip, as one of the immediate applications of the invention, it will be evident to those skilled in the art that in its broader aspects, it can be utilized and provide advantages in other similar applications of industrial processes, for example in the production of aluminum strip.

Referring to FIGS. 1, 2, 3, 4 and 5 which illustrate different views of the coiling system and where like numerals designate like elements of its structure, numeral 10 designates an upper pinch roll which cooperates with a lower pinch roll 12 for pulling a thin steel strip 14 onward (e.g., to a coiler mandrel 16). The strip travels on run-out table or cooling table rolls 18. The leading end 28 of the strip 14 is forced downwardly by flap guide 20 in contact with the roll 10 so as to prevent the strip 14, due to the high speed, from becoming wound up around pinch roll 10. The portion 22 of the flap guide 20 which is in contact with the pinch roll 10 is preferably made of a low friction, durable material to avoid wear and marking of the surface of roll 10, and is fastened to flap guide 20 by suitable conventional fastening means known in the art. Among the materials suitable for this purpose, this portion 22 may be made of a "Micarta" type phenolic or melamine resin bonded fabric composite. Flap guide 20 is movable about the pivot axis 24 by suitable actuating means 26, which latter may be for example a hydraulic or pneumatic cylinder or a cam and follower mechanism, etc. Since the tip 22 of flap guide 20 contacts the surface of the roll 10 without leaving any gap therebetween, the head end 28 of the strip 14 is forced to follow a path leading it to mandrel 16. Suitable guiding plates 30 and 32 are provided to define the path of the strip to the coiler mandrel 16.

Figure 2:
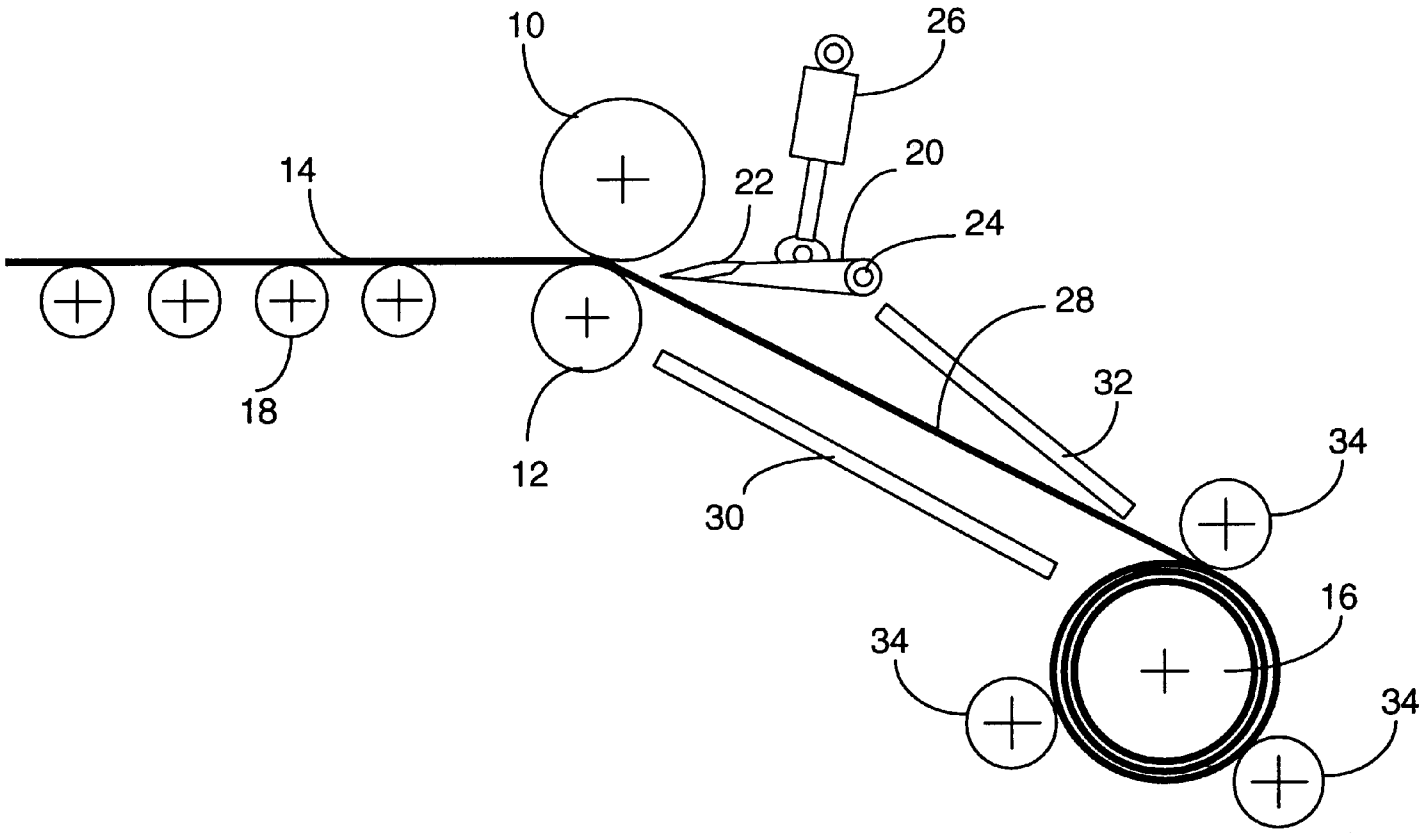
FIG. 2 is a similar schematic side elevational view of the coiler system illustrated in FIG. 1, but with the flap guide in the second position moved away from the pinch roll to leave a small gap to prevent unnecessary wear of both the guide and the pinch roller during the continued coiling of the steel strip (as it is being wound up around the coiler mandrel)
Figure 3:
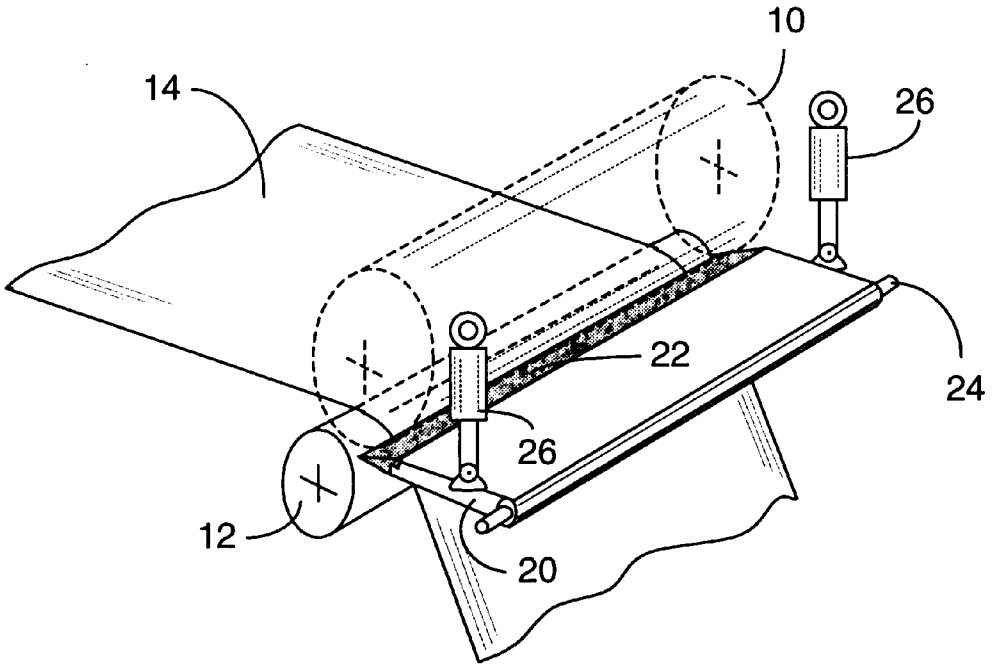
FIG. 3 is a schematic isometric view of the flap guide and associated pinch rollers (the upper roller being illustrated in phantom outline for purposes of clarity of illustration)

Once the head end 28 of the strip 14 engages and is captured by mandrel 16 and begins winding up around it, the flap guide 20 is moved by actuating means 26 to a second position, as shown in FIG. 2, where the portion 22 of said guide no longer contacts the roll 10. This second position is the normal operational position of the guide during actual coiling (to avoid on one hand excessive wear of both the roll and the guide and on the other hand to reduce the force needed to drive the upper pinch roll, while the strip is being wound up). Coiler mandrel 16 is provided with wrapper rolls 34 which contribute to formation of a regular spiral coil 36 around mandrel 16.

Figure 4:
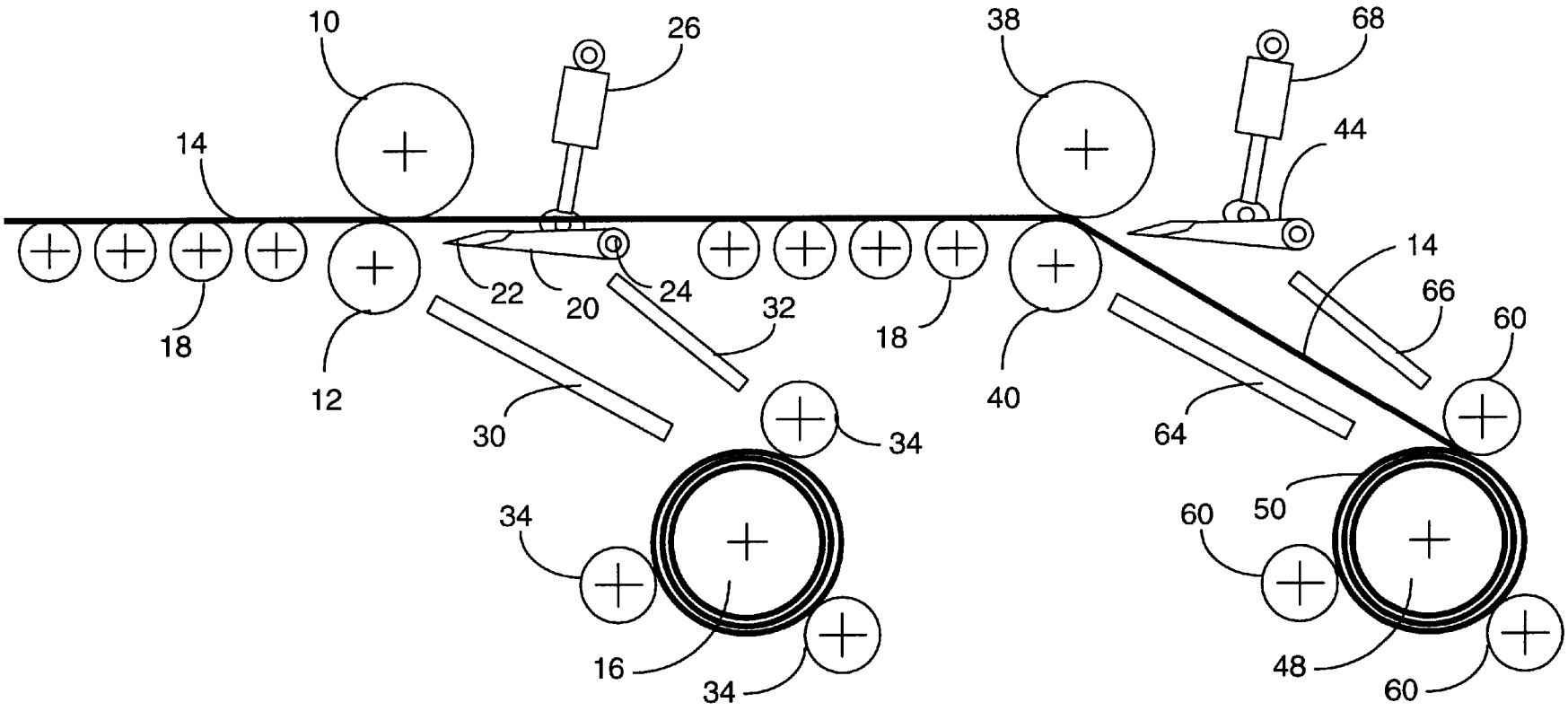
FIG. 4 is a schematic side elevational view of a further preferred embodiment of a coiler system which comprises two coiling mandrels; where the first (upstream) of the two illustrated flap guides is shown in a third position and the other (downstream) flap guide is in the second position thus allowing the steel strip to pass over the first guide and by-pass the first coiler mandrel and already having been engaged and diverted by the second flap guide down to be wound around the second coiler mandrel.

FIG. 4 illustrates a coiling system comprising two coiler sets aligned sequentially. The flap guide 20 is adapted to assume a third position in close contact with the lower pinch roll 12 (once the coil forming on mandrel 16 is completed and a new head end 28 is formed by cutting the strip 14 to enable the mandrel 48 next to be alternately loaded). The low friction tip 22 prevents the new head end 28 from being wound on the pinch roll 12. The flap guide 20 in this position allows strip 14 to pass along towards pinch rolls 38 and 40, while pinch roll 10 has been lifted to permit free passage thereby of the strip 14. After the new head end 28 has passed over the flap guide 22 (as shown in FIG. 4), the tip 22 is lifted off the surface of roller 12 back to the disengaged second position. Flap guide 44 functions in the same manner as flap guide 20 to assure diversion of the new head end 28 between the guide plates 64 and 66 and on to the respective second mandrel 48. Thereafter, the flap guide 44 shifts (by action of cylinder 68) to assume the second position (as shown in FIG. 4) while the strip 14 is being wound up around mandrel 48 forming a coil 50 in cooperation with wrapper rolls 60.

Figure 5:
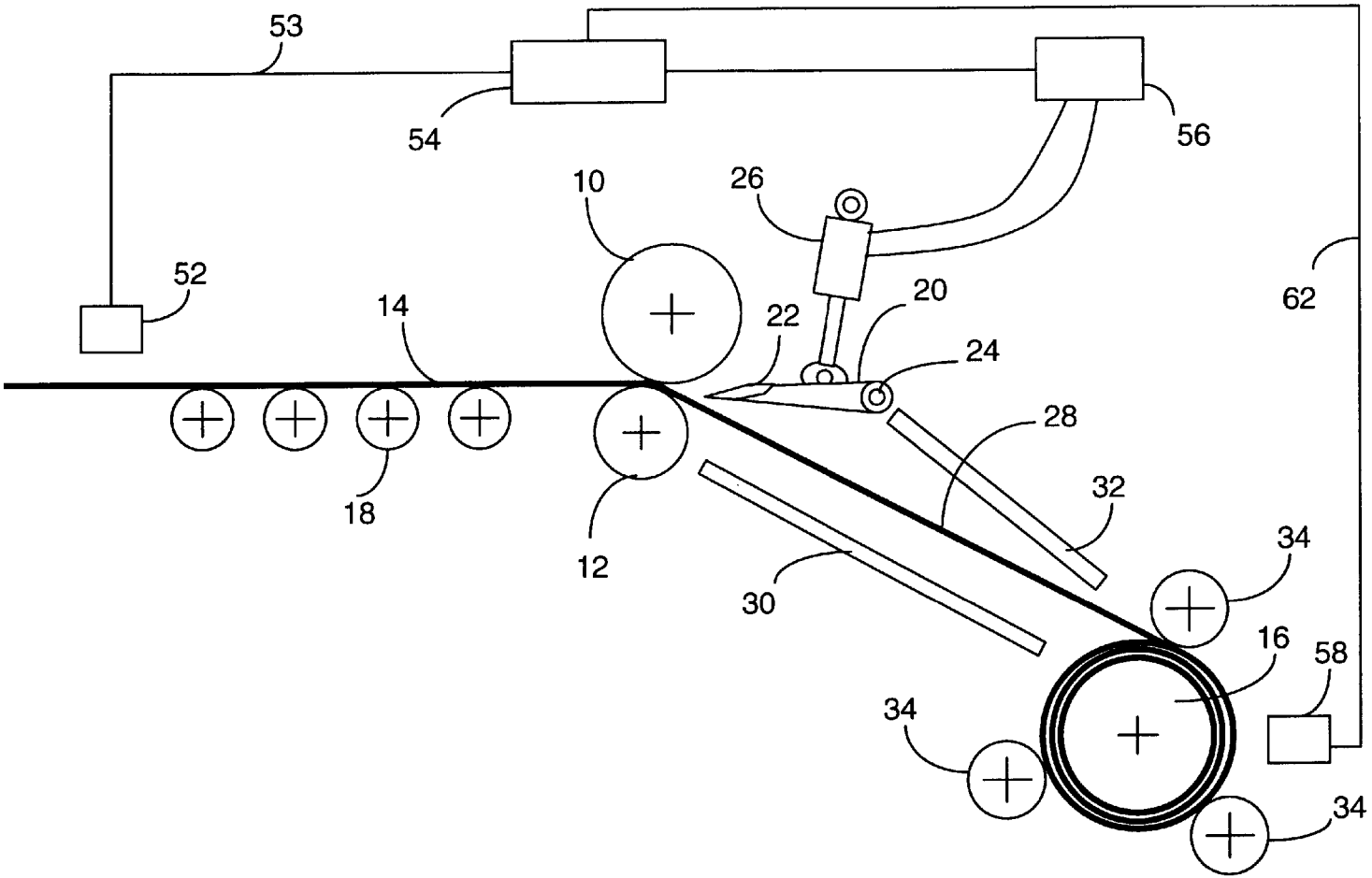
FIG. 5 is a partially diagrammic side elevational view illustrating an embodiment of the invention for automatic operation of the flap guide.

In FIG. 5 a schematic controller for automatic positioning of flap guide 20 is suggested. Sensor 52 located upstream sends a signal 53 to programmable controller 54 indicating that a head end 28 of the strip 14 is traveling towards pinch roll 10 and 12. The actuator 56, cued by the controller 54, responds to said signal 53 causing hydraulic cylinder 26 to move the guide 20 to its first position into contact with roll 10. When the strip 14 begins to be wound up on mandrel 16, sensor 58 sends a signal 62 to controller 54, which then cues the actuator 56 to cause the cylinder 26 to move the flap guide 20 to the second position (avoiding unnecessary prolonged contact of the edge portion 22 of the flap guide 20 with the pinch roll 10).

It is of course to be understood that the embodiments of the invention described above are intended to be illustrative and that it will be evident to those skilled in the art that numerous changes can be made to these embodiments without departing from the scope of the claimed invention.

What is claimed is:

1. In a high speed coiler system for thin metallic strip, the improvement comprising at least a pair of pinch rolls; at least one coiler mandrel; a flap guide positioned to intercept the head end of such thin strip emerging from said pinch rolls, said flap guide being selectively movable to at least two positions: a first position where said guide contacts at least one of said pinch rolls so that the head end of said strip is diverted to follow a path away of said pinch rolls and towards said coiler mandrel and also is prevented from winding up around said pinch rolls; and a second position, where said guide does not contact said pinch roll whereby unnecessary wearing or marking of the pinch roll surface is avoided during the coiling operation after the strip has been engaged by the coiler mandrel and is being wound up around said coiler mandrel.

2. A coiler system for thin strip according to claim 1, wherein said strip has a thickness less than about 2 mm.

3. A coiler system for thin strip according to claim 1, wherein said strip has a thickness less than about 1.5 mm.

4. A coiler system for thin strip according to claim 3, wherein said strip is steel strip.

5. A coiler system for thin strip according to claim 4, wherein said strip is wound up into a coil at a speed over 10 m/sec.

6. A coiler system for thin strip according to claim 4, wherein the portion of said guide which contacts said pinch roll is made of a low friction durable material.

7. A coiler system for thin strip according to claim 6, wherein said low friction material is a laminated plastic composed of paper or fabric made from cellulose, glass, asbestos, or synthetic fibers bonded with phenolic or melamine resins.

8. A coiler system for thin strip according to claim 7, wherein said coiler system comprises a plurality of sets of pinch rolls, flap guides and coiler mandrels and wherein said flap guides are positionable in a third position that allows said strip to pass along said guide to be coiled in another coiler mandrel of the coiler system.

9. A coiler system for thin strip according to claim 6, wherein said flap guide is adapted to be moved to said second position by means of actuating means responding to a signal indicating that the coiler mandrel has engaged said strip and that the strip is being wound up around said coiler mandrel.

10. A coiler system for thin strip according to claim 6, wherein said flap guide is adapted to be moved to said first position by means of actuating means responding to a signal indicating that the head end of a new strip is approaching said pinch rolls.

11. A coiler system for thin strip according to claim 10, wherein said flap guide is adapted to be moved to said second position by means of actuating means responding to a signal indicating that the coiler mandrel has engaged said strip and that the strip is being wound up around said coiler mandrel.

12. A coiler system for thin strip according to claim 11, wherein said flap guide is movable with respect to a pivot axis and the actuating means comprises a cam and follower device.

13. A coiler system for thin strip according to claim 11, wherein said flap guide is movable with respect to a pivot axis and the actuating means comprises a hydraulic cylinder.

14. A coiler system for thin strip according to claim 11, wherein said coiler system comprises a plurality of sets of pinch rolls, flap guides and coiler mandrels and wherein said flap guides are positionable in a third position that allows said strip to pass along said guide to be coiled in another coiler mandrel of the coiler system.

15. A coiler system for thin strip according to claim 4, wherein said coiler system comprises a plurality of sets of pinch rolls, flap guides and coiler mandrels and wherein said flap guides are positionable in a third position that allows said strip to pass along said guide to be coiled in another coiler mandrel of the coiler system.

16. A coiler system for thin strip according to claim 1, wherein said coiler system comprises a plurality of sets of pinch rolls, flap guides and coiler mandrels and wherein said flap guides are positionable in a third position that allows said strip to pass along said guide to be coiled in another coiler mandrel of the coiler system.

17. In a method for high speed coiling of thin steel strip having a thickness on the order of 1.5 mm or less in a coiler system having at least a pair of pinch rolls, at least one coiler mandrel, a flap guide pivotally oriented either to intercept in one position and bypass in another position said thin strip emerging from said pinch rolls, the improvement comprising positioning said flap guide in a first position to contact at least one of said pinch rolls when a head end of the strip emerges from between the pinch rolls when such pair of pinch rolls are both in joint pressing engagement with the strip and thus prevents the strip from winding up around said contacted pinch roll and also forces the strip to divert from the normal path of such strip to follow an angled path towards said coiler mandrel, using a material on at least the tip portion of the flap guide which makes contact with the roll and which has sufficient durability and low friction to avoid excessive wear and marking of the contacted roll, and selectively moving said flap guide to a second position to disengage any contact with said pinch rolls and strip during the coiling operation after the strip has been engaged by the coiler mandrel and is being wound up around said coiler mandrel and also when at least one of the pair of pinch rolls has disengaged the strip and thus removed the tendency of the strip to wind around such pinch roll, whereby with said guide no longer in contact with such pinch roll unnecessary wearing or marking of the pinch roll surface is avoided.

18. Method for coiling thin steel strip according to claim 17, further comprising winding said strip into a coil at a speed over 10 m/sec.

19. Method for coiling thin steel strip according to claim 18, wherein said flap guide is moved to said second position by means of actuating means responding to a signal indicating that the coiler mandrel has engaged said strip and that the strip is being wound up around said coiler mandrel.

20. Method for coiling thin steel strip according to claim 18, wherein said flap guide is moved to said second position by means of actuating means responding to a signal indicating that the coiler mandrel has engaged said strip and that the strip is being wound up around said coiler mandrel.

* * * * *